US010415815B2

(12) United States Patent
Chen

(10) Patent No.: US 10,415,815 B2
(45) Date of Patent: Sep. 17, 2019

(54) ENHANCED LAMP HOLDER INCLUDING A CONDUCTIVE SHELL AND AN INSULATION COMPONENT

(71) Applicant: DONGGUAN CITY MINLEON ELECTRONICS CO., LTD., Guangdong (CN)

(72) Inventor: Dongchang Chen, Guangdong (CN)

(73) Assignee: DONGGUAN CITY MINLEON ELECTRONICS CO., LTD., Guangdong (CN)

( * ) Notice: Subject to any disclaimer, the term of this patent is extended or adjusted under 35 U.S.C. 154(b) by 0 days.

(21) Appl. No.: 16/164,788

(22) Filed: Oct. 18, 2018

(65) Prior Publication Data

US 2019/0120473 A1 Apr. 25, 2019

(30) Foreign Application Priority Data

Oct. 20, 2017 (CN) ..... 2017 2 1375931
Oct. 12, 2018 (CN) ..... 2018 2 1663051

(51) Int. Cl.

| | |
|---|---|
| ***H01R 33/22*** | (2006.01) |
| ***F21V 23/06*** | (2006.01) |
| *H01R 33/46* | (2006.01) |
| *H01R 33/97* | (2006.01) |
| *H01R 33/94* | (2006.01) |
| *H01R 33/09* | (2006.01) |

(52) U.S. Cl.

CPC ..... *F21V 23/06* (2013.01); *H01R 33/22* (2013.01); *H01R 33/09* (2013.01); *H01R 33/46* (2013.01); *H01R 33/94* (2013.01); *H01R 33/97* (2013.01); *H01R 33/971* (2013.01)

(58) Field of Classification Search

CPC ..... H01R 33/94; H01R 33/22; H01R 33/971; H01R 33/46; H01R 33/09; H01R 33/97
USPC ..... 439/339, 220, 302, 336, 356, 699.2
See application file for complete search history.

(56) References Cited

U.S. PATENT DOCUMENTS

2007/0167053 A1* 7/2007 Karton ..... H01J 5/50 439/236
2007/0243740 A1* 10/2007 Karton ..... H01R 33/94 439/236

* cited by examiner

*Primary Examiner* — Abdullah A Riyami
*Assistant Examiner* — Justin M Kratt
(74) *Attorney, Agent, or Firm* — JCIPRNET

(57) ABSTRACT

The utility model relates to an enhanced lamp holder including a conductive shell and an insulation component installed on the conductive shell; the conductive shell includes a base and a cover extending outward from one side of the base, and the base and the cover form a cylinder with an opening; the insulation component includes a support member and a rear seat member, and the support member and the rear seat member are connected as a whole; the base is embedded and fixed between the support member and the rear seat member to form a fixing structure for fixing the insulation component; a threaded hole penetrating the support member and the rear seat member is set in the insulation component, and a conductive member is installed in the threaded hole.

6 Claims, 6 Drawing Sheets

ENHANCED LAMP HOLDER INCLUDING A CONDUCTIVE SHELL AND AN INSULATION COMPONENT

CROSS-REFERENCE TO RELATED APPLICATION

This application claims the priority benefit of China application serial no. 201721375931.5, filed on Oct. 20, 2017, and China application serial no. 201821663051.2, filed on Oct. 12, 2018. The entirety of each of the above-mentioned patent application is hereby incorporated by reference herein and made a part of this specification.

TECHNICAL FIELD

The utility model relates to the technical field of accessories of luminaire, in particular to an enhanced lamp holder.

BACKGROUND TECHNOLOGY

In a process of manufacturing and operating luminaire, the luminaire usually includes a lamp holder portion and a glass bulb portion. Glass acting as an insulation structure is often placed behind a conductive shell of a conventional lamp holder, and then a conductive contact is arranged on the glass insulator. The disadvantage of the lamp holder in this structure lies in that: the glass insulator is required to be fixed to the lamp holder through soldering, which leads to troublesome production, low productivity, and high costs. Therefore, a plastic insulator is used instead of the glass insulator, thereby avoiding the troublesome of soldering. However, the existing lamp holders with use of the plastic insulators are not scientifically reasonable in structural design, and the structure of the lamp holder is prone to be loosened, which poses a negative impact on the reliability of electric conduction and thereby causes users trouble.

SUMMARY OF UTILITY MODEL

In view of the above, it is necessary to provide an enhanced lamp holder with reasonable structural design to solve the technical issue of unreasonable structural design of the existing lamp holders.

To achieve the object of the utility model, the utility model adopts following technical solutions.

An enhanced lamp holder including a conductive shell and an insulation component installed on the conductive shell is provided. The conductive shell includes a base and a cover extending outward from one side of the base, and the base and the cover form a cylinder with an opening; the insulation component includes a support member and a rear seat member, and the support member and the rear seat member are connected as a whole; the base is embedded and fixed between the support member and the rear seat member to form a fixing structure for fixing the insulation component; a threaded hole penetrating the support member and the rear seat member is set in the insulation component, and a conductive member is installed in the threaded hole.

The enhanced lamp holder of the utility model has a design of the insulation component constituted by the support member and the rear seat member, and the insulation component is tightly combined with and fixed to the conductive shell through injection molding, so that the entire lamp holder can have a secure structure and is not loosened, and the conductive member is reliably conductive, which improves the stability of the luminaire.

DESCRIPTIONS OF ACCOMPANYING DRAWINGS

DESCRIPTIONS OF REFERENCE NUMERALS

100: an enhanced lamp holder;
10: conductive shell, 11: base, 12: cover, 13: through hole, 14: thread;
20: insulation component, 21: support member, 22: rear seat member, 23: threaded hole;
30: conductive member;
200: an enhanced lamp holder;
50: fixing hole, 60: positioning groove.

DETAILED DESCRIPTIONS OF EMBODIMENTS

In order to facilitate the understanding of the utility model, the utility model will be described below in a more comprehensive manner. However, the utility model may be embodied in many different forms and is not limited to the embodiments described herein. On the contrary, these embodiments are provided, so that the understanding of the public disclosure of the utility may be more comprehensive.

Unless otherwise defined, all technical and scientific terms used herein have the same meaning as commonly understood by people of ordinary skill in the art pertinent to the utility model. The terms used in the description of the utility model are for the purpose of describing particular embodiments and are not intended to limit the utility model.

Figure 1:
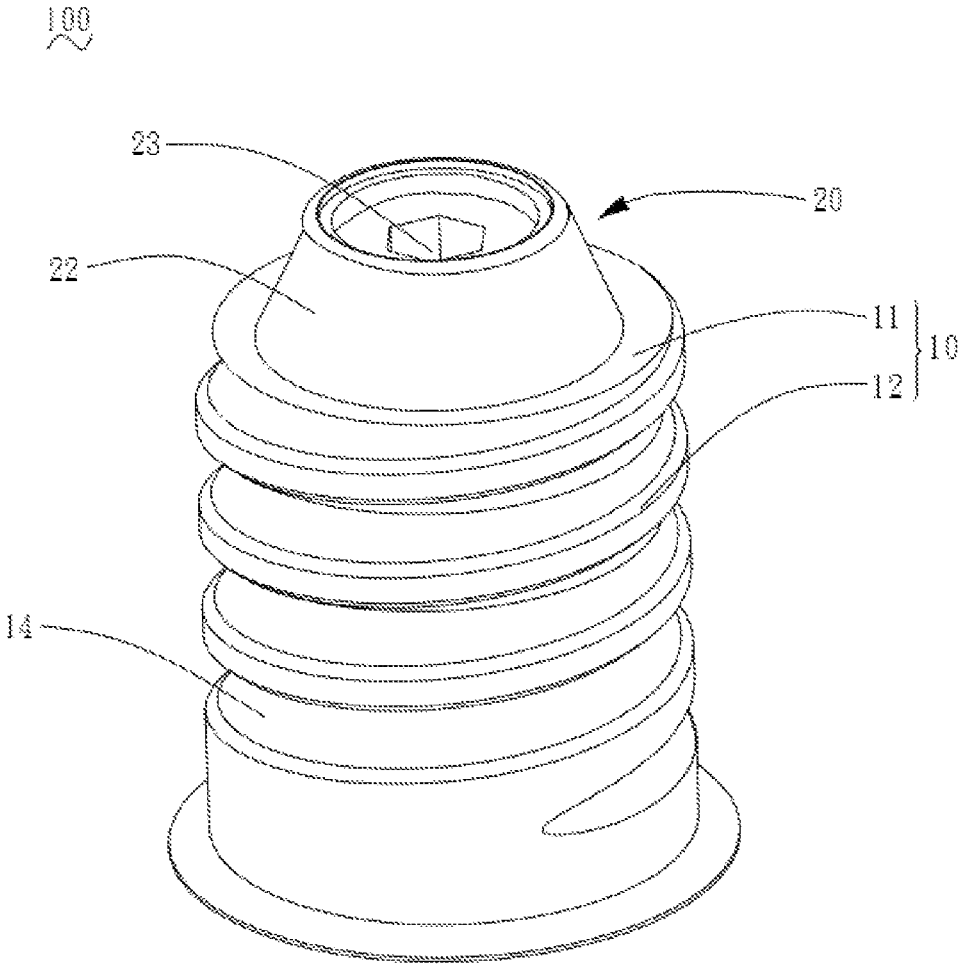
FIG. 1 is a schematic view of an enhanced lamp holder according to a first embodiment of the utility model, without showing the conductive element.
Figure 2:
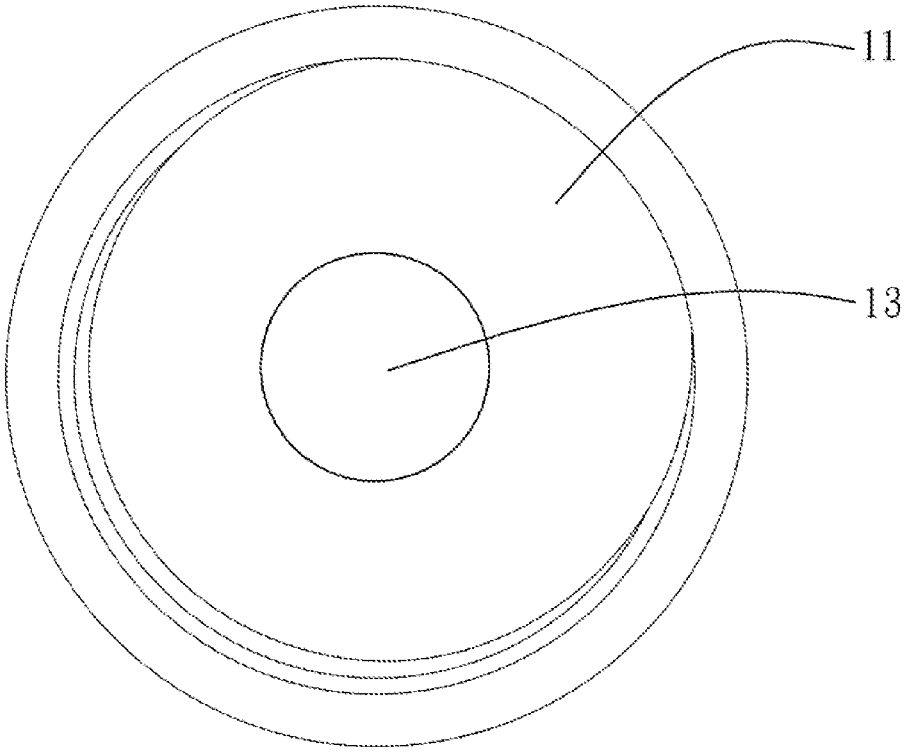
FIG. 2 is a schematic top view of the conductive shell depicted in FIG. 1.
Figure 3:
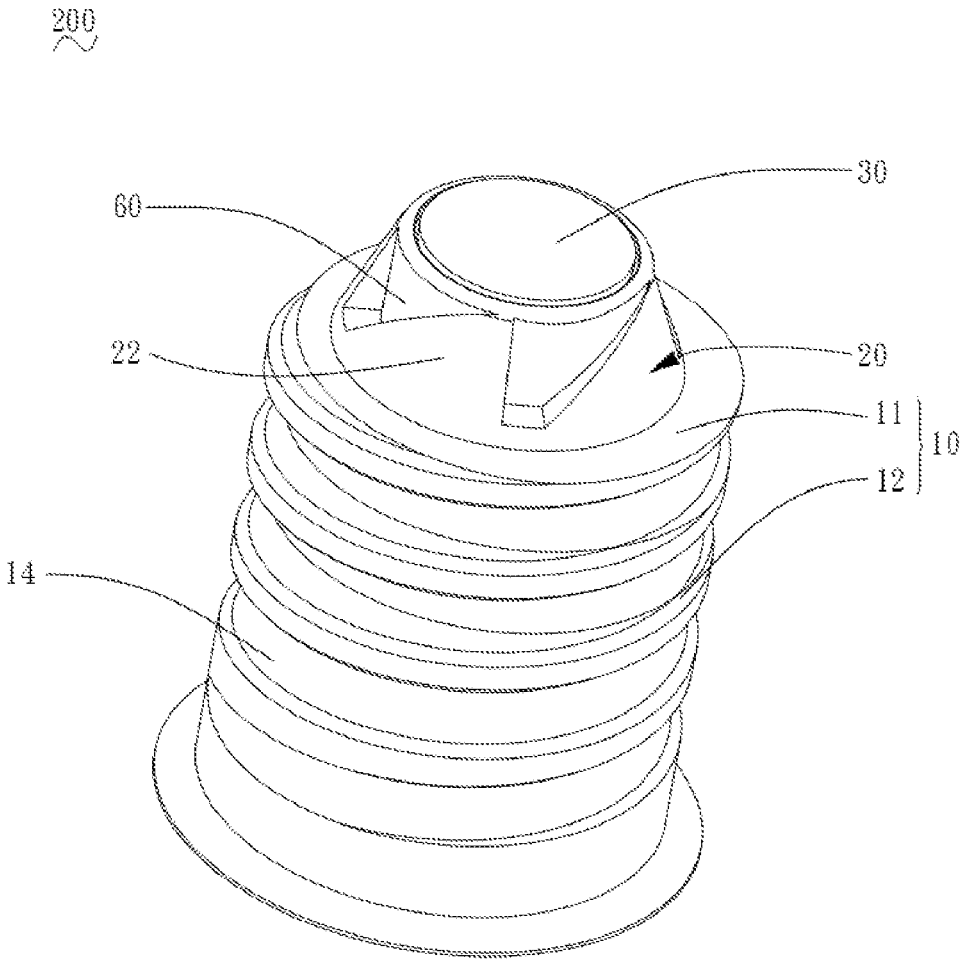
FIG. 3 is a schematic view of an enhanced lamp holder according to a second embodiment of the utility model.
Figure 4:
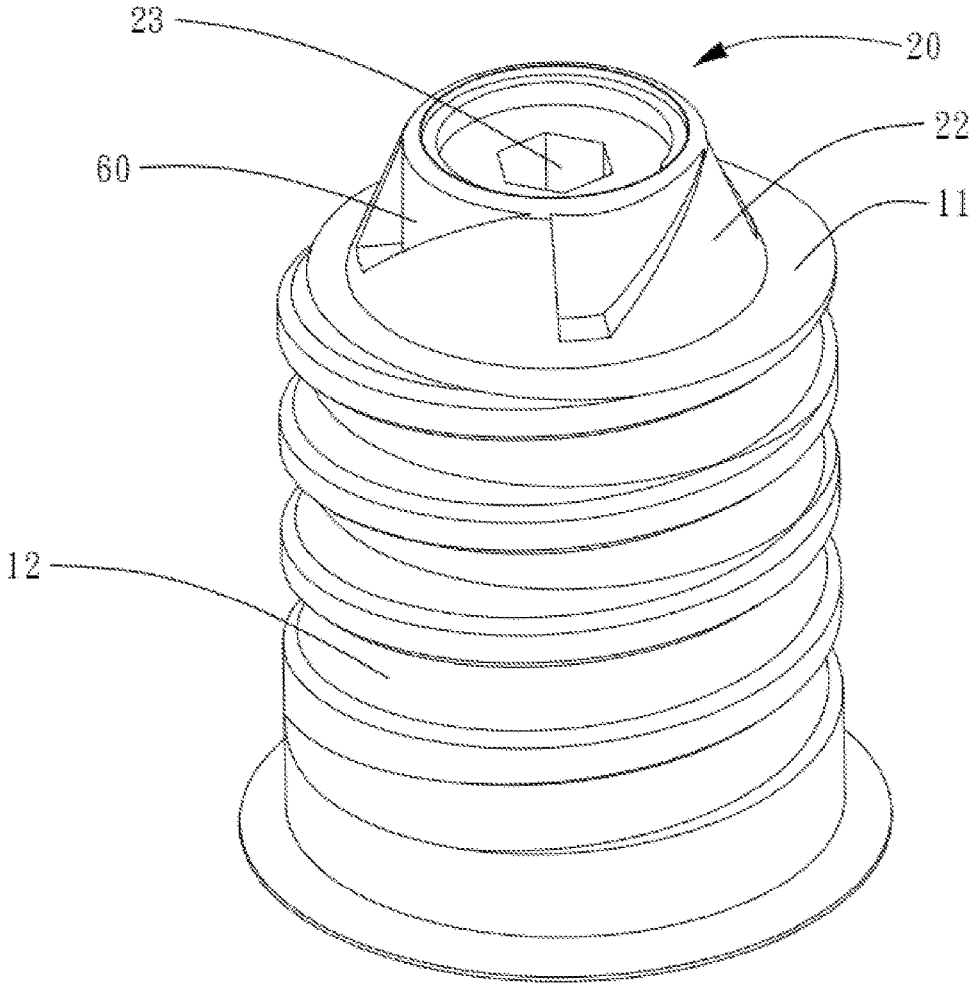
FIG. 4 is a schematic view of the enhanced lamp holder depicted in FIG. 3 without installing the conductive member.
Figure 5:
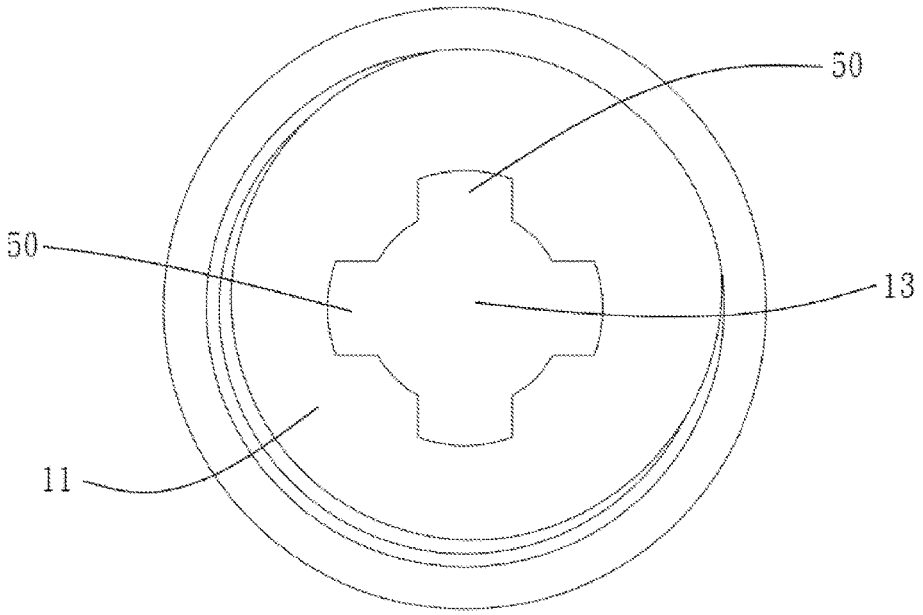
FIG. 5 is a schematic top view of the conductive shell depicted in FIG. 3.
Figure 6:
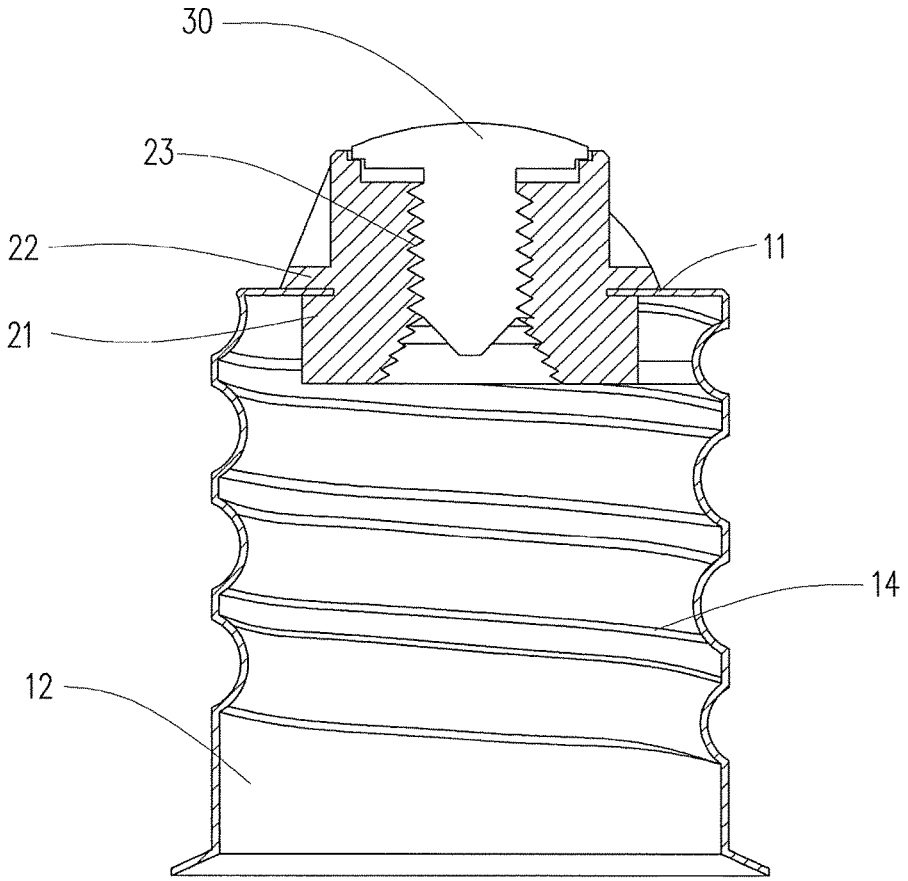
FIG. 6 is a cross-sectional view of the enhanced lamp holder depicted in FIG. 3.

With reference to FIG. 1 and FIG. 2, an enhanced lamp holder 100 provided in a first embodiment of the utility model includes a conductive shell 10, an insulation component 20 installed on the conductive shell 10, and a conductive member 30 installed on the insulation component 20; the conductive shell 10 includes a base 11 and a cover 12 extending outward from one side of the base 11, so as to form a cylinder with an opening. A through hole 13 is arranged in the base 11 to allow the insulation component 20 to be installed and placed. The insulation component 20 includes a support member 21 and a rear seat member 22, and the support member 21 and the rear seat member 22 are connected as a whole.

The through hole 13 arranged in a ring-shaped manner is arranged at an intermediate portion of the base 11 of the conductive shell 10; while the base 11 is embedded and fixed between the support member 21 and the rear seat member 22 to form a fixing structure for fixing the insulation component 20. A thread 14 is set on both an outer side and an inner side of the cover 12, and the thread 14 is configured for the installation of the enhanced lamp holder 100.

The support member 21 and the rear seat member 22 of the insulation component 20 are both made of an insulation material; further, the support member 21 is located on one side of the base 11 close to the cover 12, and the rear seat member 22 is located on one side of the base 11 away from the cover 12. In the present embodiment, the rear seat member 22 has a truncated cone structure, the support member 21 has a cylindrical structure, an outer diameter of the support member 21 is greater than a maximum outer diameter of the rear seat member 22, a rear surface of the support member 21 connected to the base has a planar structure, and the rear seat member 22 is pressed against the rear surface of the support member 21 to form a coaxial structure. Besides, a location where the support member 21 and the rear seat member 22 are coaxial has a through threaded hole 23, and the threaded hole 23 is configured to allow the conductive member 30 to be installed and placed. Besides, a front end surface of the support member 21 facing the opening of the conductive shell 10 recesses inwardly to form a structure shaped as a dome, and thereby the weight of the structure can be reduced.

The conductive member 30 is installed on the threaded hole 23 of the support member 21; in the present embodiment, the conductive member 30 is a conductive screw. On the other hand, the conductive member 30 should be ensured to protrude from the through hole 13 of the base 11 while the conductive member 30 is installed on and fixed to the threaded hole 23, so as to make sure that the conductive member 30 is able to be contact with other electronic devices for electric conduction.

When one enhanced lamp holder 100 is being assembled, the base 11 of the conductive shell 10 is embedded between the support member 21 and rear seat member 22 to be connected and fixed to the insulation component 20, so that the rear side surface of the support member 21 and the inner side surface of the base 11 are tightly connected to form a sealed structure. Second, the insulation component 20 is fixed to an end surface of the base 11 through injection molding, so as to ensure that the insulation component 20 is connected and fixed to the conductive shell 10; the conductive member 30 is then installed on the threaded hole 23 of the insulation component 20. The enhanced lamp holder 100 can achieve relatively high stability and ensure the stability of the conductive member 30, which makes electric conduction more reliable.

With reference to FIG. 3 to FIG. 6, the structure of an enhanced lamp holder 200 provided in a second embodiment of the utility model is similar to the structure of the enhanced lamp holder 100 provided in the first embodiment, while a fixing hole 50 is arranged on the base 11 of the enhanced lamp holder 200 provided in the present embodiment for the insulation component 20 to perform a heat-sealing process and thereby to prevent the insulation component 20 from loosening or idling. Several positioning grooves 60 are arranged on the outer side of the rear seat member 22, so as to facilitate the installation of the enhanced lamp holder 200.

In the present embodiment, the number of the fixing holes 50 arranged on the base 11 is four, and the fixing holes 50 and the through hole 13 on the base 11 communicate with each other to form a cross-shaped pattern; it can be understood that the number and the shape of the fixing holes 50 in other embodiments can be correspondingly adjusted according to actual production demands, i.e., the number of the fixing holes 50 may be one or more; the fixing holes 50 may communicate with the through hole 13 of the base 11 or be arranged on other portions of the base 11 as long as the fixing holes 50 are ensured to be located within the range of the connection surface between the rear seat member 22 and the base 11. Further, the base 11 is embedded and fixed between the support member 21 and the rear seat member 22 to form a fixing structure for fixing the insulation component 20, and the fixing holes 50 are configured for the insulation component 20 to be installed in the fixing holes 50 through injection molding; thereby, the insulation component 20 is tightly fixed onto the conductive shell 10 and does not loosen nor idle.

In the present embodiment, the number of the positioning grooves 60 is four; it can be understood that the number of the positioning grooves 60 in other embodiments can be correspondingly adjusted according to actual demands.

When one enhanced lamp holder 200 is being assembled, the base 11 of the conductive shell 10 is embedded between the support member 21 and rear seat member 22 to be connected and fixed to the insulation component 20, so that the rear side surface of the support member 21 and the inner side surface of the base 11 are tightly connected to form a sealed structure. Second, the insulation component 20 is fixed to the end surface of the base 11 and into the fixing holes 50 of the base 11 through injection molding, so as to ensure that the insulation component 20 does not loosen nor idle; the conductive member 30 is then installed on the threaded hole 23 of the insulation component 20. A clamping unit may then be placed on the positioning grooves 60 to facilitate the installation of the enhanced lamp holder 200 to luminaire. The enhanced lamp holder 200 can achieve relatively high stability, does not loosen, and ensure the stability of the conductive member 30, which makes electric conduction more reliable.

The enhanced lamp holder of the utility model has a design of the insulation component constituted by the support member and the rear seat member, and the insulation component is tightly combined with and fixed to the conductive shell through injection molding, so that the entire lamp holder can have a secure structure and is not loosened, and the conductive member is reliably conductive, which improves the stability of the luminaire.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this manual.

The above-mentioned embodiments are merely illustrative of several embodiments of the utility model, and the description thereof is more specific and detailed, but is not to be construed as limiting the scope of the utility model. It should be noted that a number of variations and modifications may be made by those skilled in the art without departing from the spirit and scope of the utility model. Therefore, the protection scope of the utility model should be determined by the appended claims.

What is claimed is:

1. An enhanced lamp holder characterized in comprising: a conductive shell and an insulation component installed on the conductive shell, the conductive shell comprising a base and a cover extending outward from one side of the base, the base and the cover forming a cylinder with an opening, the insulation component comprising a support member and a rear seat member, the support member and the rear seat member being connected as a whole, the base being embedded and fixed between the support member and the rear seat member to form a fixing structure for fixing the insulation component, a threaded hole penetrating the support member and the rear seat member being set in the insulation component, a conductive member being installed in the threaded hole.

2. The enhanced lamp holder as recited in claim 1, wherein a fixing hole is set on the base, and the fixing hole is located within a range of a connection surface of the rear seat member and the base.

3. The enhanced lamp holder as recited in claim 1, wherein positioning grooves are set on an outer side of the rear seat member.

4. The enhanced lamp holder as recited in claim 1, wherein the rear seat member has a truncated cone structure, the support member has a cylindrical structure, an outer diameter of the support member is greater than a maximum outer diameter of the rear seat member, a rear surface of the support member connected to the base has a planar structure, and the rear seat member is pressed against the rear surface of the support member to form a coaxial structure.

5. The enhanced lamp holder as recited in claim 1, wherein a front end surface of the support member facing the opening of the conductive shell recesses inwardly to form a structure shaped as a dome.

6. The enhanced lamp holder as recited in claim 1, wherein a thread is set on both an outer side and an inner side of the cover.

* * * * *